US007597053B2

(12) United States Patent
Muyskens

(10) Patent No.: US 7,597,053 B2
(45) Date of Patent: Oct. 6, 2009

(54) APPLIANCE BASE RAIL WITH M-SHAPED PROFILE

(75) Inventor: David B. Muyskens, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 385 days.

(21) Appl. No.: 11/307,522

(22) Filed: Feb. 10, 2006

(65) Prior Publication Data

US 2006/0180498 A1 Aug. 17, 2006

Related U.S. Application Data

(60) Provisional application No. 60/593,796, filed on Feb. 15, 2005.

(51) Int. Cl.
*B65D 19/00* (2006.01)

(52) U.S. Cl. ..... 108/51.3; 108/51.11

(58) Field of Classification Search ..... 108/51.11, 108/51.3, 57.12, 56.3; 248/638, 636, 346.02; 206/386, 600, 596, 599
See application file for complete search history.

(56) References Cited

U.S. PATENT DOCUMENTS

| | | | | | |
|---|---|---|---|---|---|
| 1,466,462 | A | | 8/1923 | Bachman | |
| 2,489,054 | A | * | 11/1949 | Sprolle | 108/51.3 |
| 2,783,011 | A | * | 2/1957 | Alexander | 108/51.3 |
| 2,957,668 | A | * | 10/1960 | Norquist et al. | 108/51.3 |
| 3,026,015 | A | * | 3/1962 | Severn | 108/51.3 |
| 3,026,078 | A | * | 3/1962 | Simkins | 108/51.3 |
| 3,029,303 | A | * | 4/1962 | Severino | 174/97 |
| 3,273,518 | A | * | 9/1966 | Shina | 108/51.3 |
| 3,331,496 | A | * | 7/1967 | Marsden et al. | 108/55.5 |
| 3,626,860 | A | * | 12/1971 | Blatt | 108/51.3 |
| 3,858,526 | A | * | 1/1975 | Lombard et al. | 108/51.11 |
| 3,907,241 | A | * | 9/1975 | Oglesby et al. | 108/51.3 |
| 3,940,101 | A | * | 2/1976 | Heidelbach | 108/51.3 |
| 4,116,344 | A | * | 9/1978 | Ziemba | 108/51.3 |
| 4,119,205 | A | * | 10/1978 | Delany | 108/56.3 |
| 4,140,295 | A | | 2/1979 | Daley | |
| 4,183,491 | A | | 1/1980 | Sanders et al. | |
| 4,293,605 | A | * | 10/1981 | Persson et al. | 108/51.3 |
| 4,317,517 | A | * | 3/1982 | Tisdale | 206/597 |
| 4,399,972 | A | | 8/1983 | McCulloch | |
| 4,445,614 | A | * | 5/1984 | Mitsumori et al. | 108/56.1 |
| 4,509,433 | A | * | 4/1985 | Farr | 108/51.3 |
| 4,610,355 | A | | 9/1986 | Maurer | |
| 4,863,024 | A | | 9/1989 | Booth | |
| 4,869,456 | A | | 9/1989 | Jacobs | |
| 5,269,219 | A | | 12/1993 | Juvik-Woods | |
| 5,493,962 | A | | 2/1996 | McCarthy | |
| 5,509,534 | A | * | 4/1996 | Taravella et al. | 206/587 |
| 5,537,937 | A | | 7/1996 | Juvik-Woods | |
| 5,934,202 | A | | 8/1999 | Lai | |
| 6,155,527 | A | | 12/2000 | Muyskens | |
| 6,264,157 | B1 | | 7/2001 | Muyskens | |
| 6,357,364 | B1 | | 3/2002 | Maloney et al. | |

* cited by examiner

*Primary Examiner*—José V Chen
(74) *Attorney, Agent, or Firm*—Clausen Miller PC

(57) ABSTRACT

A base rail for supporting an object such as a large household appliance is provided. The base rail is a composite rail made from paperboard and resilient foam blocks. The resilient foam blocks are captured within the paperboard to provide a strong, cushioned platform for an appliance or other large object.

2 Claims, 1 Drawing Sheet

APPLIANCE BASE RAIL WITH M-SHAPED PROFILE

FIELD OF THE INVENTION

This patent relates to appliance bases or pallets. More particularly, this patent relates to a low cost appliance base rail that can cushion and protect a large appliance.

DESCRIPTION OF THE RELATED ART

Base pads, sometimes referred to as carriers, skids, runners, pallets, or simply bases, are used to cushion and protect objects such as large appliances during assembly, storage and transport. Numerous appliance bases are known in the art, including bases made of wood, plastic, corrugated paper, and composite bases made of a combination of materials. Sonoco Development, Inc., the owner of the present invention, owns a number of patents in this field, including U.S. Pat. Nos. 6,155,527 and 6,264,157.

Appliance manufacturers are continually seeking better, more cost effective bases to provide cushioning and protection for large household appliances. Thus it is an object of the present invention to provide an appliance base that provides cushioning and protection of large appliances at reduced cost.

A further object of the invention is to provide an appliance base rail that is lightweight, yet passes standard drop tests and resists breakage.

Further and additional objects will appear from the description, accompanying drawings, and appended claims.

SUMMARY OF THE INVENTION

The present invention is a composite (multiple material) base rail for supporting for an object such as a large household appliance. The base rail comprises a rectangular paperboard planar member or base sheet, a folded paperboard member having an M-shaped cross-sectional profile glued to the base sheet, and a plurality of resilient foam members captured within or substantially surrounded by the paperboard members. The combination of foam members captured within the paperboard members provides a cushioned yet strong support for the appliance.

The folded paperboard member comprises edge panels, at least two beads or crowns longitudinally disposed along the length of the folded member between the edge panels, and a central panel disposed between the two beads. Each bead comprises a top, load bearing, panel that contacts the object to be supported and two downwardly extending side panels. The folded M-shaped member is adhered to the rectangular base sheet along the edge panels so that the two pieces define a pair of longitudinal cavities there between. The central panel can be affixed to the base sheet but need not be.

At least one first resilient foam member is interposed between the beads and captured on three sides by the central panel and two opposing downwardly extending side panels. At least one pair of second resilient foam members are captured within the longitudinal cavities adjacent the at least one first resilient foam member. The foam members fortify the base rail so that it can withstand the load from a large object with minimal deformation.

In the preferred embodiment, a first resilient foam member is disposed at either end of the base rail between the beads and a pair of second resilient foam members is disposed at either end of the base rail within the longitudinal cavities adjacent the first resilient foam members. Two base rails may be used in parallel to support and cushion a refrigerator or other object. Alternatively, a cross member (made from angle board or of other suitable construction) may be used to connect two parallel base rails to form a U-shaped base. In another alternative a pair of cross members can be used to connect two parallel base rails to form a square or rectangular base.

THE DRAWINGS

DETAILED DESCRIPTION OF THE INVENTION

Figure 1:
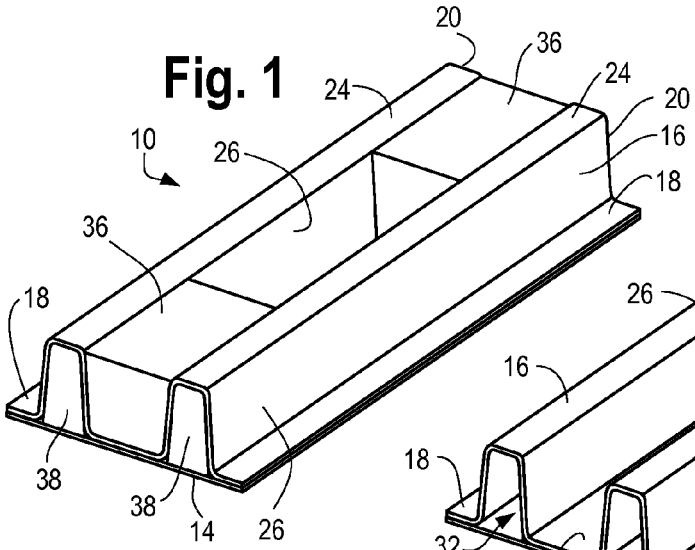
FIG. 1 is a perspective view of an appliance base rail according to the present invention.

Turning to the drawings, there is shown in FIG. 1 one embodiment of the present invention, a base rail 10 for supporting an object such as a large household appliance. The base rail 10 is a composite rail made from paperboard sheets and resilient foam blocks. The resilient foam blocks are captured by and within by the paperboard sheets to provide a strong, cushioned platform for a large object.

Figure 2:
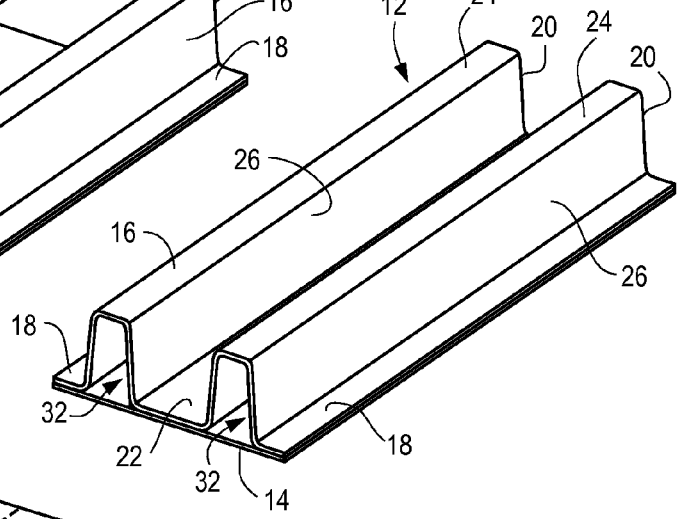
FIG. 2 is a perspective view of the paperboard component of the appliance base rail of FIG. 1.

The base rail 10 comprises a paperboard component and a number of resilient foam blocks. FIG. 2 is a perspective view of the paperboard component 12. The paperboard component in turn is made from a rectangular, substantially planar base sheet 14 and a folded member 16. The folded member 16 has a substantially M-shaped cross-section.

Still referring to FIG. 2, the folded member 16 comprises edge panels 18 affixed to the base sheet 14, at least two crowns or beads 20 longitudinally disposed along the length of the folded member between the edge panels 18, and a central panel 22 disposed between the two beads 20. Each bead comprises a top, load bearing panel 24 and two downwardly extending side panels 26.

Figure 3:
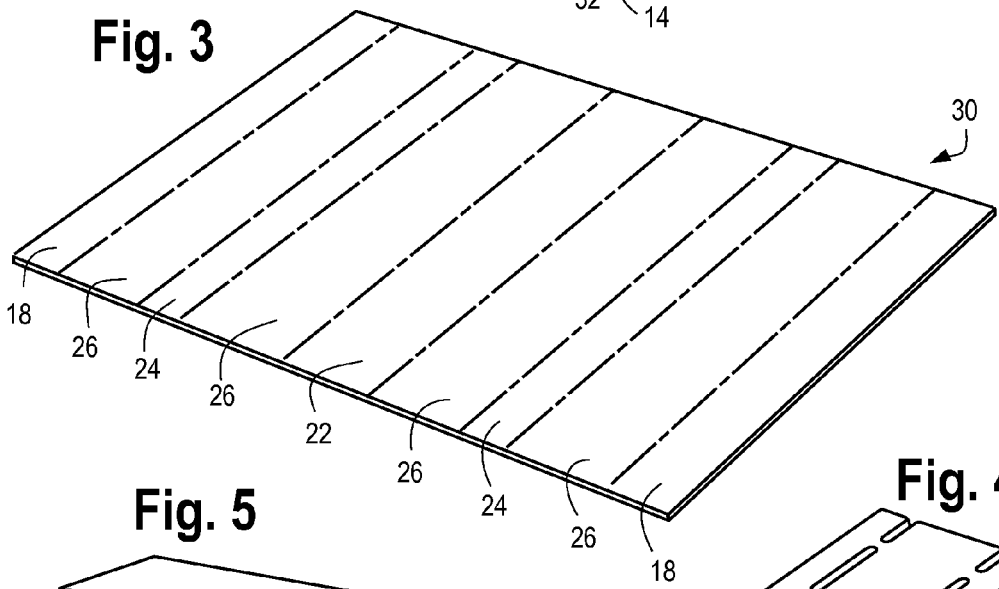
FIG. 3 is a blank used to make the M-shaped portion of the paperboard component of FIG. 2.

FIG. 3 is a perspective view of a blank 30 used to make the folded member 16. The blank 30 is generally rectangular in shape and has fold lines running longitudinally which help define the edge panels 18, central panel 22, top panels 24 and side panels 26.

In the assembled paperboard component 12 of FIG. 2 the edge panels 18 of the folded paperboard member 16 are glued or otherwise affixed to the base sheet 14. Preferably the base sheet 14 and the folded member 16 have the same horizontal dimensions (that is, their perimeters or edges are coextensive) and the central panel 22 is adjacent to the base sheet 16. The central panel 22 may be but need not be affixed to the base sheet 14. The base sheet 14 and the folded member 16 define a pair of longitudinal channels or cavities 32 there between.

Figure 4:
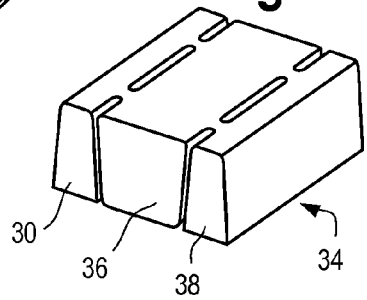
FIG. 4 is a perspective view of the resilient foam components of the appliance base rail of FIG. 1.
Figure 6:
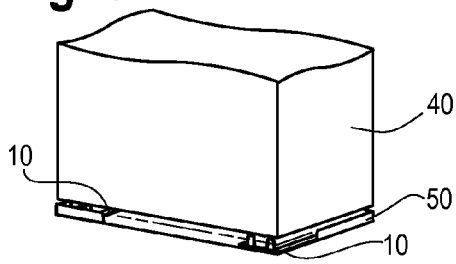
FIG. 6 is a perspective view of the refrigerator mounted on a pair of appliance base rails according to FIG. 1, shown with a bottom tray.

As shown in FIG. 4 the resilient foam members may be made from a single block 34 of resilient foam material (such as expanded polystyrene foam) that is cut or divided into a first resilient foam member 36 and two second resilient foam members 38. The second foam members 38 are configured to fit tightly within the longitudinal cavities 32 in the paperboard component 12, as explained further below.

In the assembled base rail 10 shown in FIG. 1, first resilient foam members 36 are placed at either end of the base rail 10 between the beads 20 so that they are captured on three sides by the central panel 22 and two opposing downwardly extending side panels 26 of the folded member 16. Two second resilient foam members 38 are captured within the longitudinal cavities 32 at either end of the paperboard component 12. Each pair of second resilient foam members 38 should be adjacent a first resilient foam member 36. In other words, each pair of second resilient foam members 38 should be aligned in the transverse (cross) direction with a first foam member 36. In all, six resilient foam members are used in each base rail 10.

Wedging the first resilient member 36 between the beads 20 and capturing the second resilient members 38 inside the cavities 32 adjacent the first resilient foam member 36 results in a structure that can withstand the load of a large object with very little deformation of the folded paperboard member 16. The base rail 10 both protects and cushions an object mounted on it, and replaces more costly bases. The base rail 10 can be used with a forklift truck or other lifting equipment.

Figure 5:
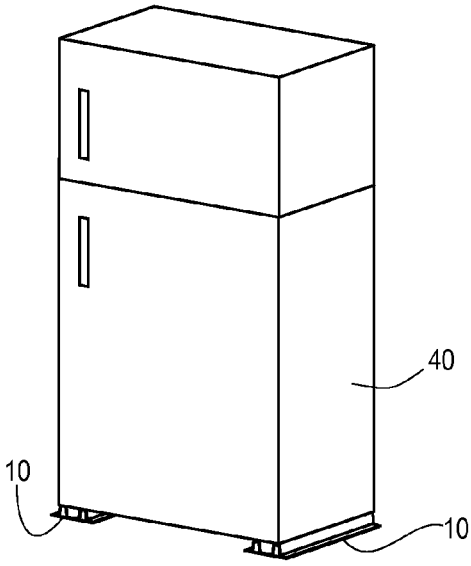
FIG. 5 is a perspective view of a refrigerator mounted on a pair of appliance base rails according to FIG. 1.

FIG. 5 shows an object, a refrigerator 40, mounted on a pair of base rails 10 spaced parallel to each other. The feet of the refrigerator extend down between the beads 20 in each rail 10 and may be wedged against the inner walls of the first resilient foam members 36.

Alternatively, a pair of base rails 10 can be connected together with a cross member (not shown) such as angle board to form a U-shaped appliance base. In a further alternative, a pair of base rails 10 can be connected together at their ends with two cross members to form a square shaped appliance base.

The base rail 10 of the present invention can be used in conjunction with other packaging components to provide an open sided appliance package. For example, a bottom tray 50 with short upstanding sides can be placed under an appliance 40 mounted on a pair of base rails 10 and a top cap placed on top. Corner posts can be placed within the bottom tray 50 between the appliance 40 and tray sidewalls and extend from the bottom tray 50 to the top cap to protect the appliance edges. Finally, clear plastic wrap can be stretched around the assembly to protect the appliance from dust and dirt.

Other modifications and alternative embodiments of the invention are contemplated which do not depart from the scope of the invention as defined by the foregoing teachings and appended claims. It is intended that the claims cover all such modifications that fall within their scope.

What is claimed is:

1. A composite base rail system comprising a bottom tray with upstanding sides and one or more base rails for cushioning and supporting an object, the base rail comprising:

a flat rectangular base sheet formed from a first paperboard sheet;

a folded member formed from a second paperboard sheet, the folded member comprising two elongated rectangular edge panels, each edge panel defining a rectangular surface that is affixed to an opposing edge of the base sheet, two parallel, spaced apart, upwardly extending beads longitudinally disposed along the length of the folded member between the edge panels, each bead comprising a flat, load bearing top panel and inner and outer downwardly extending side panels, each side panel defining an obtuse included angle with the top panel, the folded member further comprising a central panel extending between the inner side panels adjacent the base sheet and connected to the inner side panels along fold lines;

the bead inner side panels and the central panel defining three sides of a center space having a trapezoidal cross section;

the two beads and the base sheet defining a pair of elongated cavities, each cavity having a trapezoidal cross section;

at least one first resilient foam member interposed between the beads and having a trapezoidal cross sectional shape complementary to that of the center space such that the first resilient foam member is captured on three sides by the central panel and the two inner side panels; and at least one pair of second resilient foam members, each second resilient foam member having a trapezoidal cross sectional shape complementary to that of the longitudinal cavities such that each second resilient foam member is captured within one of the two longitudinal cavities;

wherein the second resilient foam members and the first resilient foam members are substantially coextensive; and wherein the base rails are placed within the bottom tray with the base sheet adjacent the bottom tray.

2. The composite base rail system of claim 1 wherein the number of first resilient foam members is two and the number of second resilient foam members is four, and wherein the first resilient foam members are located at opposing ends of the center space and the second resilient foam members are located at opposing ends of each cavity.

* * * * *